US006663580B1

(12) United States Patent
Adams

(10) Patent No.: US 6,663,580 B1
(45) Date of Patent: Dec. 16, 2003

(54) MASSAGING DEVICE WITH ROTATING BEATERS

(76) Inventor: William A. Adams, 5905 Labath Ave., #204, Rohnert Park, CA (US) 94928

( * ) Notice: Subject to any disclaimer, the term of this patent is extended or adjusted under 35 U.S.C. 154(b) by 0 days.

(21) Appl. No.: 09/621,324

(22) Filed: Jul. 21, 2000

(51) Int. Cl.[7] ..... A61H 23/02
(52) U.S. Cl. ..... 601/111; 601/112
(58) Field of Search ..... 601/46, 107–113, 601/118, 120–123, 125–127, 130, 128, 129, 94–95, 97, 101–104; D24/211, 214, 215

(56) References Cited

U.S. PATENT DOCUMENTS 2,290,407 A * 7/1942 Collins ..... 128/48
3,039,457 A * 6/1962 Boudkevitch et al. ..... 601/107
3,077,878 A * 2/1963 Baulard-Cogan ..... 128/57
3,095,874 A * 7/1963 Frajdenrajch ..... 128/57
3,374,784 A * 3/1968 Brent et al. ..... 601/133
4,150,668 A * 4/1979 Johnston ..... 601/94
4,197,448 A * 4/1980 Harigai ..... 219/370
4,546,765 A * 10/1985 Adams ..... 128/55
4,669,452 A * 6/1987 Osawa ..... 128/36
4,716,891 A * 1/1988 Yorgan ..... 601/115
4,721,100 A * 1/1988 Hengl ..... 128/49
4,825,853 A * 5/1989 Iwamoto et al. ..... 128/36
4,993,408 A * 2/1991 Schweisfurth ..... 128/57
5,577,995 A * 11/1996 Walker et al. ..... 601/120
5,824,013 A * 10/1998 Allen ..... 606/240
6,071,253 A * 6/2000 Rivera ..... 601/118
6,089,664 A * 7/2000 Yoshida ..... 297/284.4

* cited by examiner

*Primary Examiner*—Nicholas D. Lucchesi
*Assistant Examiner*—Victor Hwang
(74) *Attorney, Agent, or Firm*—Jack Lo

(57) ABSTRACT

A massaging device includes a motor, and a rotatable head attached to the motor. A hinged handle is attached to the motor for providing an adjustable grip. Resilient beaters are arranged radially around the head. The beaters are respectively connected to keys by narrowed necks. The keys are detachably secured in longitudinal slots on the head, so that the beaters are detachable from the head. When the head is set spinning by the motor, the beaters are rotated for massaging the body to relax muscles or reduce cellulite. The beaters are easily removable from the slots for exchanging them with replacement beaters. Each beater is comprised of a resilient core, such as foam, completely enclosed by a flexible non-tacky cover, such as a neoprene or vinyl sheet. Although many resilient materials, such as foam, tend to be sticky enough to grab hair if exposed, the beaters do not grab hair because the resilient cores are completely enclosed by the non-tacky covers.

3 Claims, 1 Drawing Sheet

MASSAGING DEVICE WITH ROTATING BEATERS

BACKGROUND OF THE INVENTION

1. Field of the Invention

This invention relates generally to massaging devices.

2. Prior Art

Numerous devices, for massaging a person's body are known. Most are provided with the familiar vibrating head for soothing and relaxing muscles with vibrations. A different massaging device is disclosed in U.S. Pat. No. 4,546,765 to Adams for breaking down cellulite or lumpy fat tissue to smooth out the skin. It is comprised of a motorized rotating head, and a set of rotating beaters attached to the head in radial positions. The beaters are each comprised of a flexible sheet wrapped around a resilient foam core. When the head is activated, the spinning beaters beat and stretch the skin to break down the cellulite. The foam cores are exposed at the ends of the beaters. Since soft foam is tacky or slightly sticky, short body hair may get caught by the exposed foam and pulled out when the beaters are rotating, and long hair on the head may also get caught by the exposed foam and become wrapped around the beaters. The exposed foam cores thus present a possible safety hazard.

BRIEF SUMMARY OF THE INVENTION

Accordingly, the objectives of the present massaging device are:

to relax muscles;

to reduce cellulite;

to provide user replaceable beaters;

to provide an adjustable handle for comfort; and to avoid pulling on body hair for safety.

The present massaging device includes a motor, and a rotatable head attached to the motor. A hinged handle is attached to the motor for providing an adjustable grip. Resilient beaters are arranged radially around the head. The beaters are respectively connected to keys by narrowed necks. The keys are detachably secured in longitudinal slots on the head, so that the beaters are detachable from the head. When the head is set spinning by the motor, the beaters are rotated for massaging the body to relax muscles or reduce cellulite. The beaters are easily removable from the slots for exchanging them with replacement beaters. Each beater is comprised of a resilient core, such as foam, completely enclosed by a flexible non-tacky cover, such as a neoprene or vinyl sheet. Although many resilient materials, such as foam, tend to be sticky enough to grab hair if exposed, the beaters do not grab hair because the resilient cores are completely enclosed by the non-tacky covers.

DETAILED DESCRIPTION OF THE INVENTION

Figure 1:
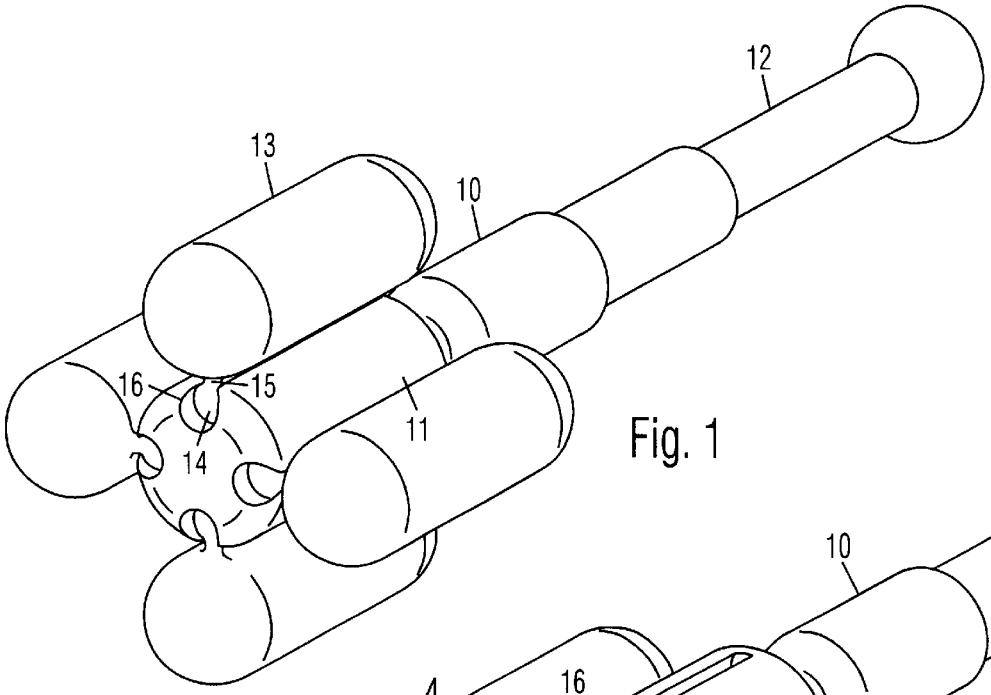
FIG. 1 is a side perspective view of the present massaging device.

A preferred embodiment of the present massaging device is shown in a side perspective view in FIG. 1. It is comprised of a motor 10, and a rotatable head 11 attached to motor 10. Internal batteries or an AC power cord may be provided to power motor 10. A hinged handle 12 is attached to motor 10 for providing an adjustable grip. Resilient beaters 13 are arranged radially around head 11. Four beaters 13 are shown in this example, but more or fewer may be provided. Beaters 13 are respectively connected to keys 14 by narrowed necks 15. Keys 14 are detachably secured in longitudinal slots 16 on head 11, so that beaters 13 are detachable from head 11. Beaters 13 are preferably comprised of cylinders which are parallel to head 11. The ends of beaters 13 are preferably hemispherical for comfort. Alternatively, beaters 13 may be of another shape. When head 11 is set spinning by motor 10, beaters 13 are rotated for massaging the body to relax muscles or reduce cellulite.

Figure 2:
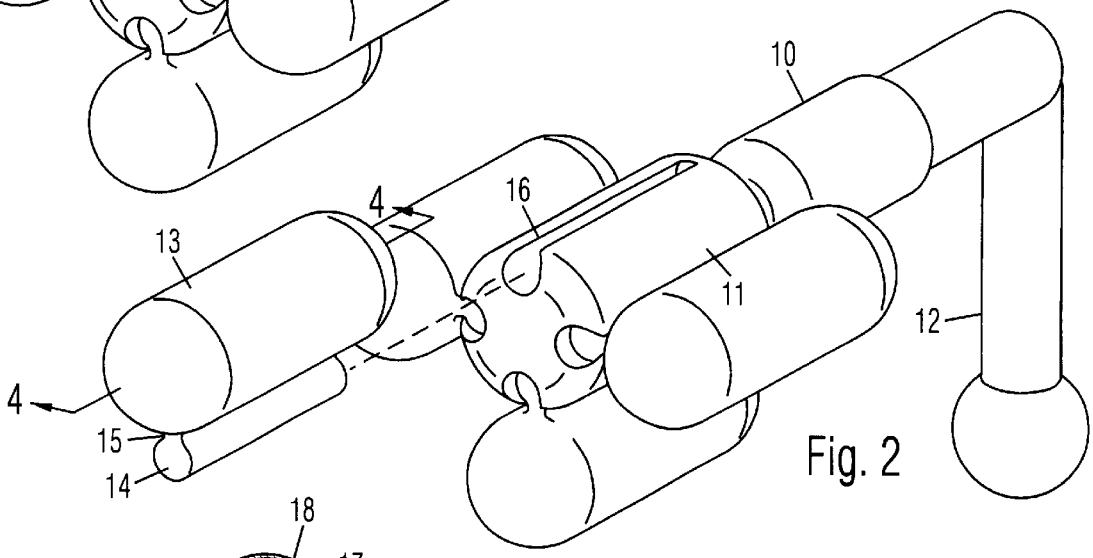
FIG. 2 is a side perspective view thereof with a beater detached and a handle pivoted.

As shown in FIG. 2, each beater 13 is easily removable from its slot 16 for exchanging it with a replacement beater. Handle 12 is shown pivoted to another position for comfort.

Figure 3:
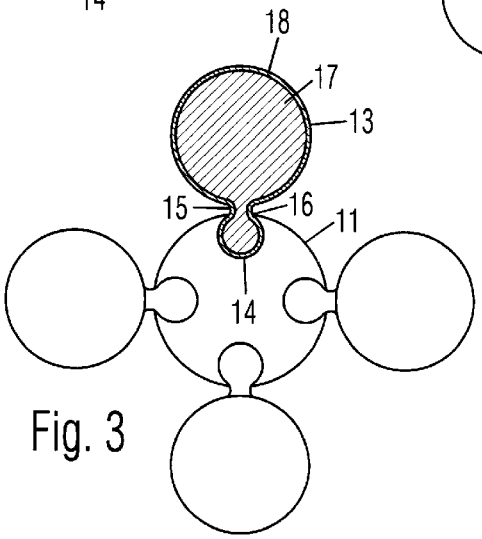
FIG. 3 is an end view thereof with one beater shown in section.
Figure 4:
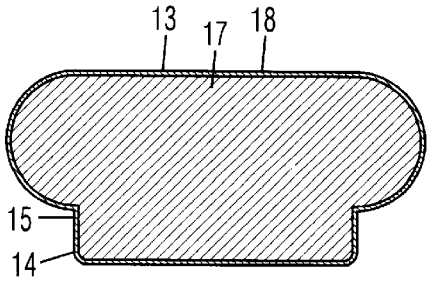
FIG. 4 is a side sectional view of a beater taken along line 4—4 in FIG. 2.

As shown in FIGS. 3 and 4, each beater 13 is comprised of a resilient core 17 completely enclosed by a flexible non-tacky cover 18. Resilient core 17 may be comprised of any suitable resilient material, such as foam. Although many resilient materials, such as foam, tend to be sticky enough to grab hair if exposed, beater 13 does not grab hair because resilient core 17 is completely enclosed by non-tacky cover 18 all around its sides as shown in FIG. 3, and its ends as shown in FIG. 4. Non-tacky cover 18 is preferably comprised of a neoprene or vinyl sheet, and should also be smooth to avoid abrading the skin.

Although the cores of key 14 and neck 15 are shown as being integral with resilient core 17, they may be made of a more rigid and durable material than resilient core 17, such as flexible plastic. Therefore, resilient cores 17 are only necessary in beaters 13.

Accordingly, the present massaging device is suitable for massaging the body to relax muscles or reduce cellulite. It provides user-replaceable beaters. It provides an adjustable handle for comfort. Most importantly, it positively avoids pulling on body hair for safety.

Although the above description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A massaging device for reducing cellulite, comprising:

a motor;

a rotatable head attached to said motor;

longitudinal slots arranged in radial positions around said head;

keys detachably positioned in respective slots;

flexible necks with inner ends attached to respective keys;

beaters attached to outer ends of respective necks;

wherein said beaters are comprised of resilient tacky cores which extend into respective necks and keys, and a flexible non-tacky cover completely enclosing sides and ends of said resilient tacky cores for avoiding grabbing hair;

wherein when said head is set spinning by said motor, said beaters are rotated for massaging the body and reducing said cellulite;

said beaters are removable from said slots for replacement.

2. The massaging device of claim 1, wherein said non-tacky cover is comprised of a neoprene sheet.

3. The massaging device of claim 1, wherein said non-tacky cover is comprised of a vinyl sheet.

* * * * *